US005178902A

United States Patent [19]

Wong et al.

[11] Patent Number: 5,178,902

[45] Date of Patent: Jan. 12, 1993

[54] HIGH PERFORMANCE COMPOSITE COATING

[75] Inventors: Dennis Wong, Toronto; Jiri Holub, Rexdale; Joseph G. Mordarski, Brampton, all of Canada

[73] Assignee: Shaw Industries Ltd., Rexdale, Canada

[21] Appl. No.: 741,598

[22] Filed: Aug. 7, 1991

Related U.S. Application Data

[63] Continuation-in-part of Ser. No. 631,454, Dec. 21, 1990.

[51] Int. Cl.[5] ..... B05D 1/06; B05D 1/34

[52] U.S. Cl. ..... 427/470; 427/195; 427/292; 427/318; 427/424; 427/425; 427/426; 427/410

[58] Field of Search ..... 427/410, 318, 29, 424, 427/425, 195, 292, 426

[56] References Cited

U.S. PATENT DOCUMENTS

| | | | |
|---|---|---|---|
| 3,077,422 | 2/1963 | Slatkin | 427/424 |
| 3,453,134 | 7/1969 | Haw | 427/29 |
| 3,687,704 | 8/1972 | Stanley et al. | 427/29 |
| 3,904,346 | 9/1975 | Shaw et al. | 427/29 |
| 4,048,355 | 9/1977 | Sakayori et al. | 427/375 |
| 4,060,655 | 11/1977 | Johannes et al. | 427/29 |
| 4,213,486 | 7/1980 | Samour et al. | 427/29 |
| 4,312,902 | 1/1982 | Murase et al. | 427/386 |
| 4,345,004 | 9/1982 | Miyata et al. | 428/426 |
| 4,386,996 | 6/1983 | Landgraf et al. | 156/382 |
| 4,451,413 | 5/1984 | Stucke et al. | 264/26 |
| 4,481,239 | 11/1984 | Eckner | 428/35.9 |
| 4,501,632 | 2/1985 | Landgraf et al. | 156/187 |
| 4,510,007 | 4/1985 | Stucke | 156/244.12 |
| 4,519,863 | 5/1985 | Landgraf et al. | 156/244.12 |
| 4,685,985 | 8/1987 | Stucke | 427/410 |
| 4,752,497 | 6/1988 | McConkey et al. | 427/195 |
| 4,990,383 | 2/1991 | Bergström et al. | 427/195 |

FOREIGN PATENT DOCUMENTS 9003850 4/1990 PCT Int'l Appl. .

*Primary Examiner*—Shrive Beck
*Assistant Examiner*—Diana L. Dudash
*Attorney, Agent, or Firm*—Ridout & Maybee

[57] ABSTRACT

Two methods are provided for applying and forming a protective composite coating on a metallic substrate. In the first method, the substrate is heated to a temperature between about 175° C. and 275° C. and a powdered coating of epoxy resin between 100 and 400 microns thick is applied to the outer surface of the heated substrate. A premixed powder coating of epoxy resin and polyolefin is applied directly onto the epoxy resin coating, forming an interlayer of interspersed domains of epoxy and polyolefin between about 100 and 400 microns in thickness. On to this, powdered polyolefin is sprayed to produce a polyolefin sheath coating for the metallic substrate between 200 and 1000 microns in thickness. In the second embodiment of the method, the interlayer is formed by spraying pure epoxy resin powder and polyolefin powder from separate sources simultaneously onto the substrate. By these methods, a metallic substrate coated with a composite epoxy/polyolefin protective coating is produced. A particular advantage of the methods results from the fact that the powders are applied in a common spray booth through which the substrate is advanced.

13 Claims, 4 Drawing Sheets

HIGH PERFORMANCE COMPOSITE COATING

CROSS REFERENCE TO RELATED APPLICATION

This application is a continuation-in-part of our co-pending application Ser. No. 07/631,454 filed Dec. 21, 1990 for HIGH PERFORMANCE COMPOSITE COATING.

FIELD OF THE INVENTION

The present invention relates to the coating of metal parts and is more particularly concerned with methods of applying protective composite coatings to elongate metal structures such as, for example, steel pipes.

BACKGROUND OF THE INVENTION

Protective coatings are extensively used to protect metallic substrates, such as steel pipes and pipelines, from corrosion and mechanical damage. Widely used commercially-available coatings for such substrates include fusion bonded epoxy coatings. A typical process for producing a fusion bonded epoxy coating is described in U.S. Pat. No. 3,904,346 (Shaw et al), and involves the electrostatic spraying of the epoxy resin in powder form onto a preheated steel pipe which has been blast cleaned.

Fusion bonded epoxy coatings are especially popular for pipeline protection because of their excellent anti-corrosion properties, good adhesion to metal surfaces and resistance to cathodic disbondment from the metallic substrate. However, when used in isolation, fusion bonded epoxy coatings are prone to handling damage during pipe installation and also exhibit relatively high moisture permeation. It has therefore been found that additional protective layers must be used with fusion bonded epoxy coatings for maximum usefulness. A preferred protective layer is a polyolefin outer sheath, polyolefins having many of the qualities lacking in fusion bonded epoxy coatings, such as superior impact resistance, as well as improved impermeability to moisture and many chemicals, as described in U.S. Reissue Pat. No. 30,006 (Sakayori et al). Polyolefins are also easy to fabricate for coating. However, because of their non-polarity, polyolefins bond poorly with metallic substrates. Even the use of adhesives, such as copolymers, in bonding the polyolefin to the metallic substrate has not been found to provide a coating with equal properties to the epoxy/metal bond described above in terms of resistance to hot water immersion and cathodic disbondment.

Examples of multilayer coatings utilizing both a fusion bonded epoxy layer and a polyolefin layer are described in U.S. Pat. Nos. 4,048,355 (Sakayori, et al); 4,213,486 (Samour, et al); 4,312,902 (Murase, et al); 4,345,004 (Miyata, et al); 4,481,239 (Eckner); 4,685,985 (Stucke); 4,519,863 (Landgraf et al); 4,510,007 (Stucke); 4,501,632 (Landgraf); 4,451,413 (Stucke et al); and 4,386,996 (Landgraf et al). Most of these coatings are three-layer systems consisting of an epoxy primer, a copolymer adhesive and a polyolefin outer sheath. Two-layer systems consisting of an epoxy primer and an unmodified polyolefin top coat have not been successful due to poor bonding between the layers. Therefore, the basic principle in the three-layer systems is the use of an adhesive middle layer to provide the bonding agent between the epoxy primer and the polyolefin outer sheath.

OBJECT OF THE INVENTION

It is an object of the present invention to provide an integral composite coating method for metallic substrates which eliminates the use of an expensive adhesive tie layer between the epoxy primer layer and the polyolefin outer layer, yet which yields the superior performance properties of three-layer coatings.

It is a further object of the invention to provide a method of applying a composite protective coating to a metal substrate in which the component resins are applied to the substrate in powder form but which, in contrast to previously known methods of powder coating, eliminates the need for successive reheating of different powder layers and the need for separate reclamation systems for successive powder application stages.

SUMMARY OF THE INVENTION

According to the invention, an improved method of applying a protective coating to a metallic substrate comprises the steps of preheating the substrate to a temperature between about 175° C. and 275° C., and applying to the substrate successive powders, namely a first powder consisting of epoxy resin, a second powder consisting of an epoxy resin-polyolefin mixture containing between about 20% and 80% epoxy resin by weight, and a third powder consisting of polyolefin to a thickness between about 200μ and 1000μ. The first application of epoxy resin powder fuses at the temperature of the preheated substrate to form a substantially even primer coating between about 100μ and 400μ in thickness, and the second powder consisting of the epoxy resin-polyolefin powder mixture similarly fuses to form an interlayer of interspersed domains of epoxy and polyolefin of substantially even thickness between about 100μ and 400μ. The third application of polyolefin powder is thereafter fused to form a smooth continuous coating bonded to the interlayer and thereafter, the coated substrate is cooled to room temperature where the said method is applied to the coating of an elongate metal object, such as a steel pipe, the object is conveyed in the direction of its length through a powder booth in which the successive powder are applied sequentially to the outer surface of the object, the first and second powders being fused at the temperature of the outer surface and the third powder consisting of polyolefin being fused to form a smooth continuous sheath bonded to the interlayer. Thus the need of successive reheating stages is eliminated and the use of a single powder booth eliminates the need for successive powder reclamation stages.

Coating processes in accordance with the invention, as applied to the coating of steel pipes, will now be described by way of example with reference to the accompanying drawings.

DETAILED DESCRIPTION OF THE PREFERRED EMBODIMENTS

Figure 1:
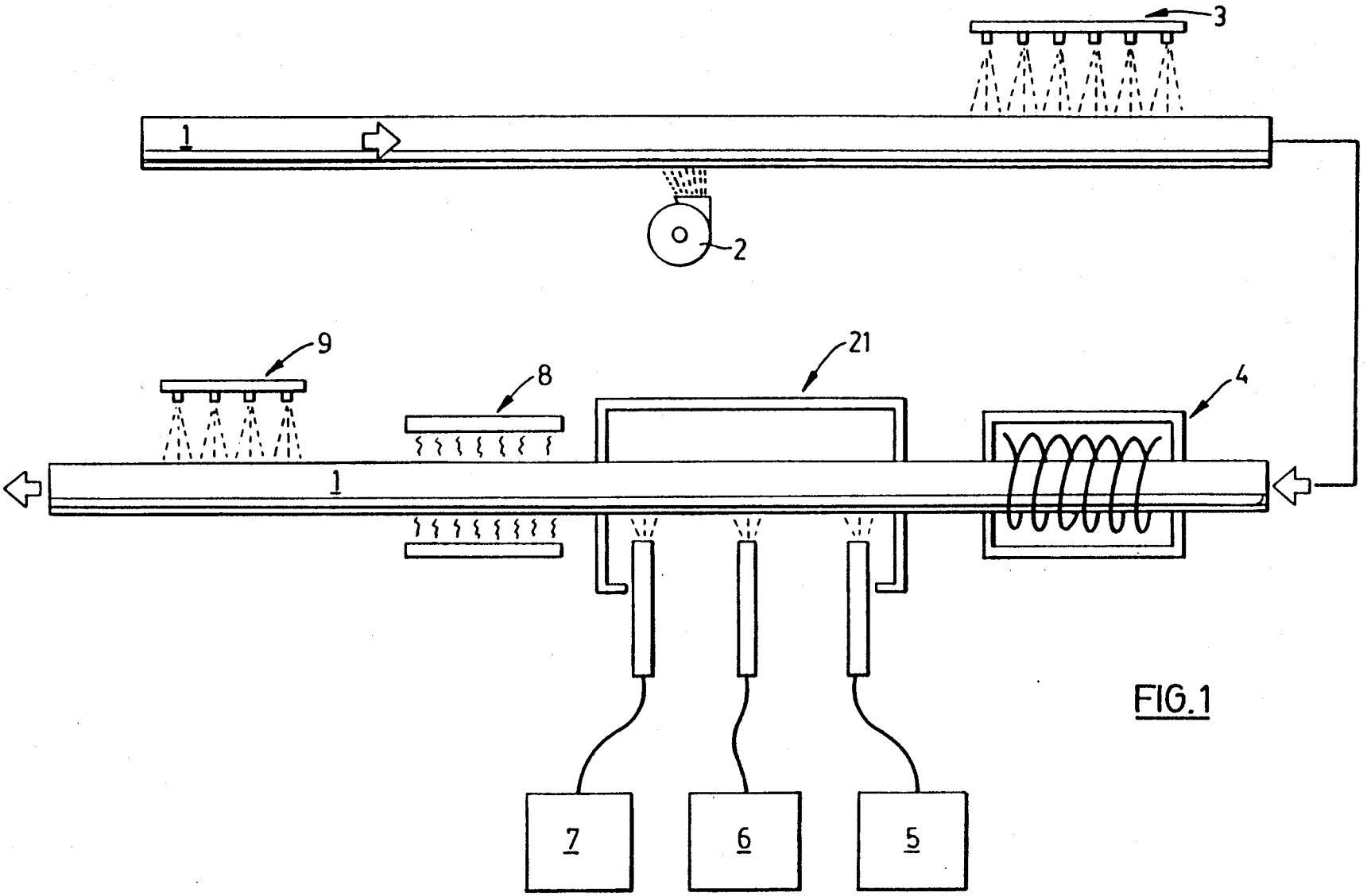
FIG. 1 is a schematic plan view of the entire pipe coating process, the pipe being conveyed in the direction being as indicated by arrows shown in the drawing, initially from left to right across the upper of the drawing, and then from right to left across the lower part of the drawing.

As shown in FIG. 1, a metallic pipe substrate 1, such as piping for a pipeline, is prepared by conveying the pipe in the direction of its length through a shot blast 2, in order to blast clean the surface of the substrate 1 to a minimum near white finish to give an anchor pattern of between 25 and 100 microns in depth. Finishing the steel surface of the substrate in this manner improves bonding with the epoxy resin primer to be applied, as described below.

Figure 2:
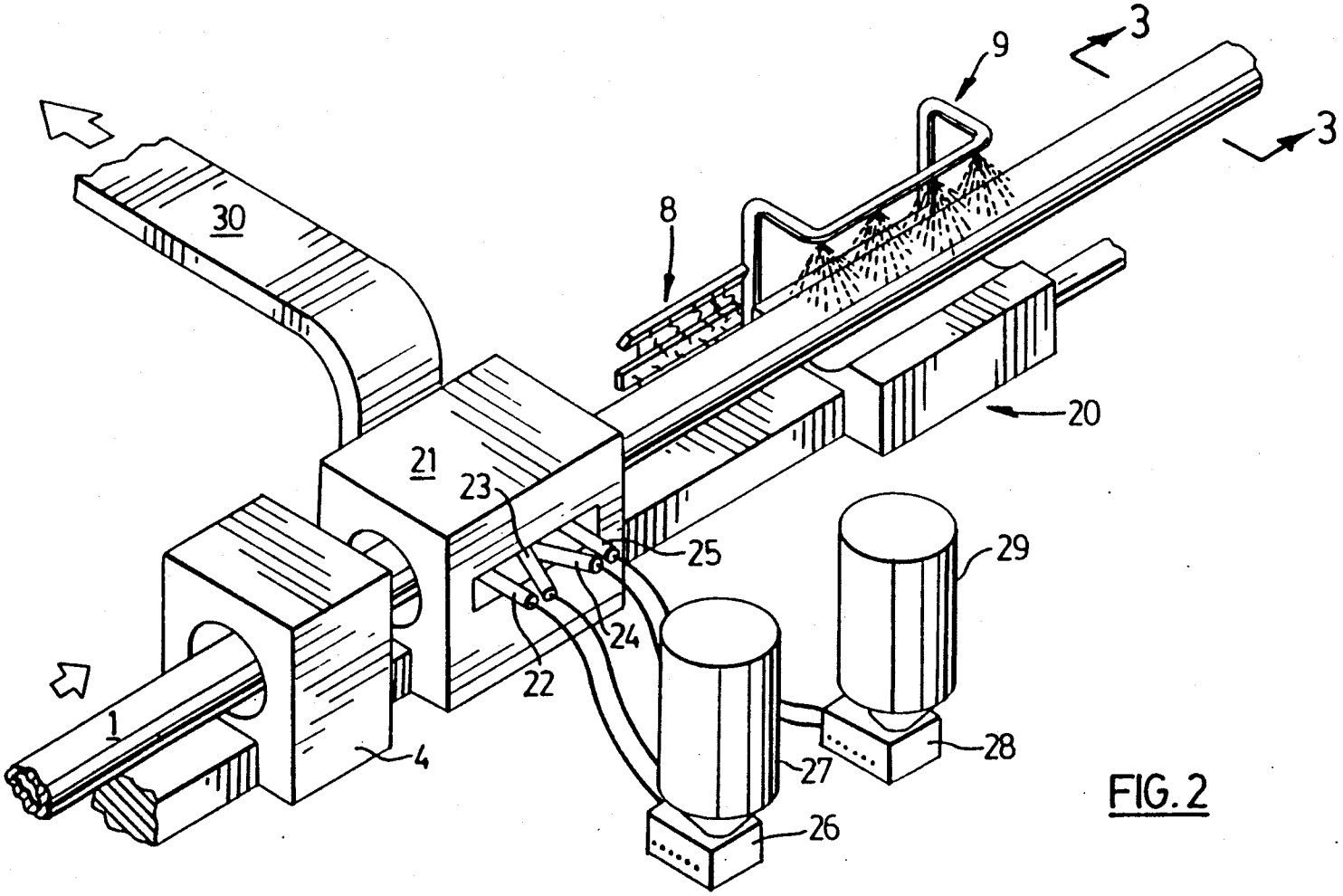
FIG. 2 is a schematic perspective view of a modification of a portion of the pipe coating process.

The conveyor, not shown in FIG. 1, is shown in FIG. 2, the conveyor advancing the pipe continuously in the direction of its length through each of the pipe treatment stages. Following surface blasting, the pipe 1 is conveyed through a wash 3 to remove metallic dust and particles adhering to the substrate 1 as a result of the blasting. The cleaned substrate 1 is then ready for application of a composite protective coating. The pipe passes through a preheating stage 4, which may be a heating coil or similar apparatus, to heat the pipe substrate 1 to a temperature in the range of 175° C. to 275° C. and preferably between 232° C. and 260° C. for maximum effect.

The preheated pipe is next conveyed through a powder booth 21 wherein successive coverings of powder are applied sequentially to the outer surface of the pipe as it passes through the booth, as will now be described.

Figure 3:
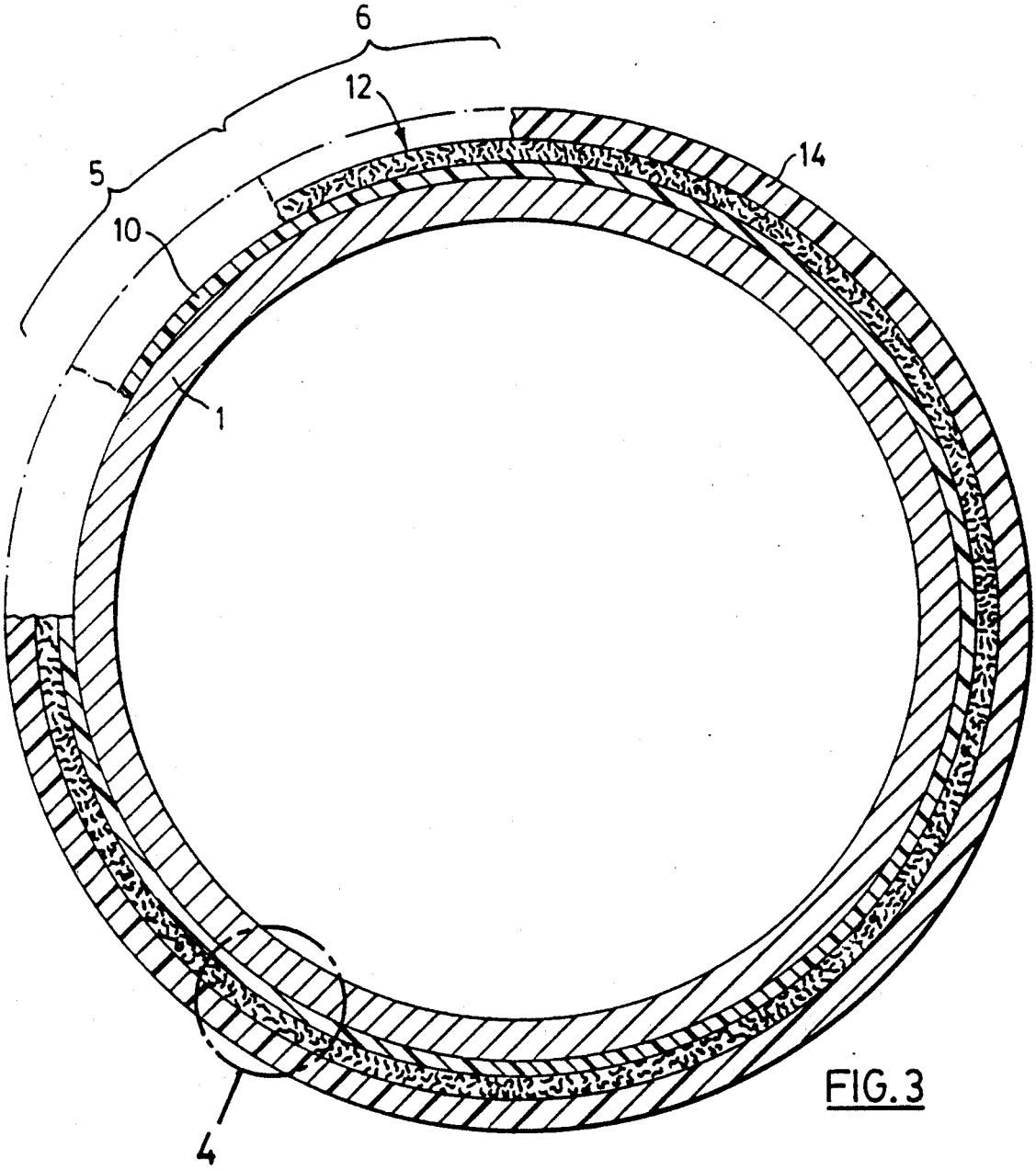
FIG. 3 is a cross sectional view taken along section line 3—3 of FIG. 2.

The preheated pipe 1 passes through a first powder application stage 5 where a primer covering 10 (see FIG. 3), 100 to 400 microns thick, of epoxy resin powder is applied electrostatically to the substrate. The heat of the substrate causes the epoxy resin powder to melt and bond with the metallic surface of the pipe. For total coverage and evenness of application of the powders, it is preferred that the pipe substrate 1 be constantly rotated about a horizontal axis as it is advanced in the direction of its length through the various powder application stages.

Figure 4:
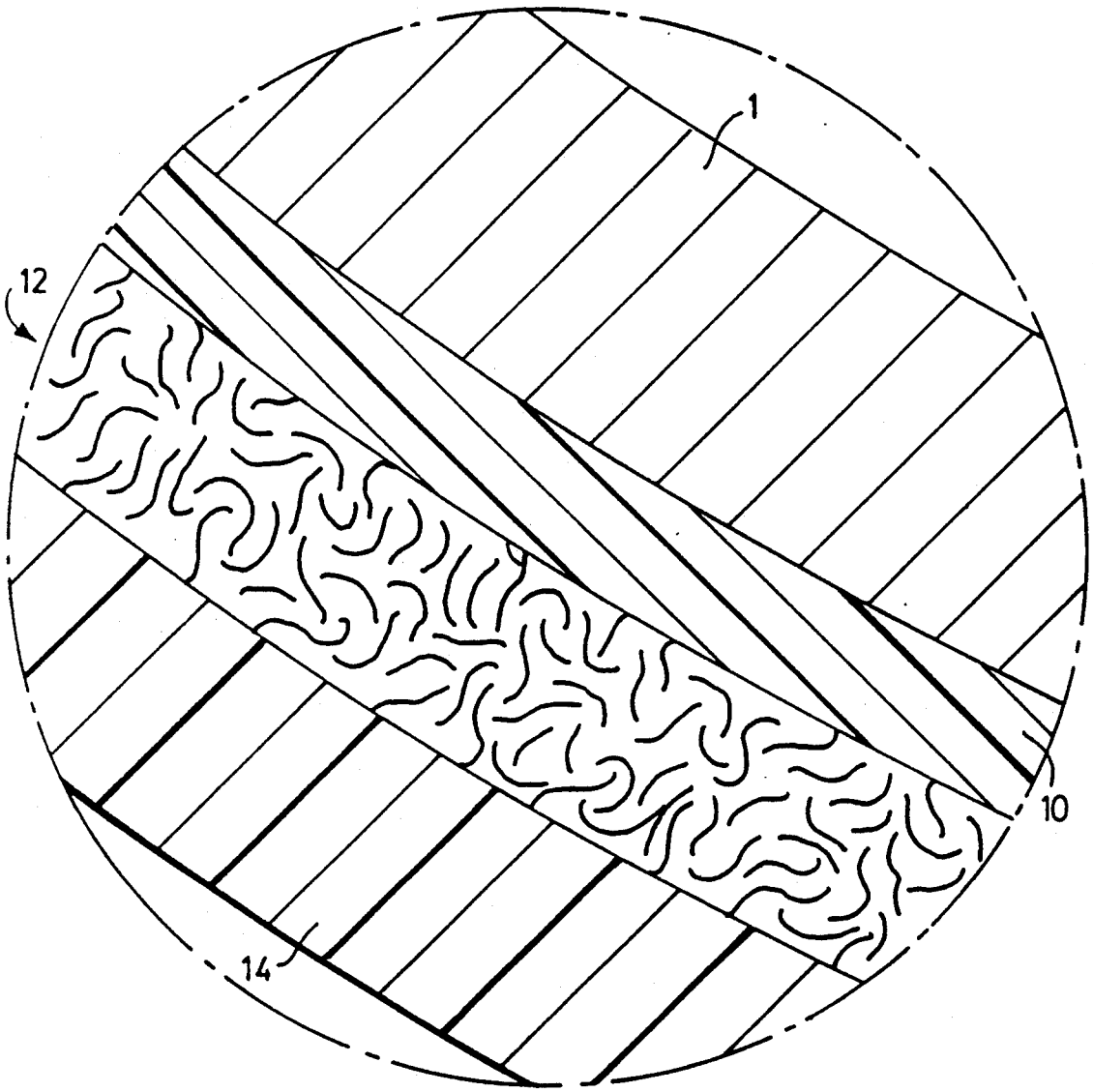
FIG. 4 shows a detail of FIG. 3 on an enlarged scale.

From the epoxy primer application stage 5, the preheated pipe substrate 1 passes to a second stage 6 where a premixed powder of epoxy resin and polyolefin particles is sprayed onto the prime coating. The thickness of this intermediate layer or interlayer is again between 100 and 400 microns. The epoxy/polyolefin interlayer also melts on contacting the preheated pipe substrate 1, but as the epoxy is not chemically reactive with polyolefin, the interlayer does not thereby form a blended copolymer layer. Rather, as shown in FIG. 4, the particulate elements of the epoxy and the polyolefin, mixed in powdered form, form a melt-fused interlayer consisting of interspersed and interlocked domains or tendrils of epoxy and polyolefin, the epoxy particles fuse-bonding with other epoxy particles in the interlayer 12 and with the epoxy primer 10 on the substrate 1, and the polyolefin particles fuse bonding in the interlayer 12 which is thereby prepared for bonding of a polyolefin sheath 14 at the tertiary coating stage 7 (FIG. 1).

The content of epoxy resin powder in the epoxy resin-polyolefin mixture may be between 20% and 80% by weight, although to achieve the maximum strength in bonding with the primer 10, it is preferred that the ratio of epoxy to polyolefin by weight be in the range of 50/50 to 80/20. Following the application of the interlayer, pure polyolefin powder is spray applied to the preheated substrate 1 at a tertiary coating stage 7 to coat the substrate 1 with an outer covering or sheath 14 between 200 and 1000 microns thick.

For certain applications the polyolefin powder of the interlayer may be pure unmodified or virgin polyolefin, the use of which can result in excellent pipe coating, but the process requires very tight control. The addition of modified polyolefin to the mixture simplifies the coating process and gives more consistent properties. Thus for the coating of steel pipe it is generally preferable that the polyolefin powder of at least the epoxy resin-polyolefin mixture of the second coating stage be a mixture of unmodified and modified polyolefin, the proportion of modified polyolefin being in the range 20% to 50% by weight. Such modified polyolefins, serving as adhesives, are characterized by the presence of chemically active acrylate and maleic acid groups and are well known in the art. One such modified polyolefin is the copolymer sold under the Trademark "LOTADER PX 8460".

The outer covering of polyolefin 14 is also fused by residual heat from the pipe. However, the heat transfer is slow if this outer covering is thick and it may be desirable to accelerate the fusing of the outer covering by a post-heating stage. Thus, in one preferred embodiment of the invention, following the three coating stages 5, 6 and 7, within the booth 21, the pipe 1 continues through a post-heating stage 8 positioned outside the powder booth 21 adjacent to its exit end to melt-fuse the outer polyolefin covering by external application of heat and so form a smooth continuous sheath surrounding the pipe 1. A preferred post-heating technique involves the use of an infrared heater emitting radiation of wavelengths between 3 and 10 microns.

Prior to exiting the process, the pipe 1 is cooled by passing it through a water quench 9, as is described in detail in co-pending U.S. Ser. No. 07/362,934, assigned to the assignee of the present application.

In FIG. 1, separate sources of powder for the three coating stages are shown, the epoxy/polyolefin mixture for application as the interlayer being premixed and isolated from both the epoxy and polyolefin powders of the first and third powder application stages.

A modification of the process is illustrated in FIG. 2. After passing through the preheater 4, the pipe substrate 1 is conveyed on the pipe conveyor 20 through a powder booth 21 which is serviced by electrostatic powder guns 22, 23, 24 and 25, which apply the powder from powder beds 26 and 28, fed respectively from powder storage bins 27 and 29. In this embodiment, no separate premixture of epoxy/polyolefin powder is provided. Rather, the powder bed 26 (fed by the bin 27) supplies pure epoxy resin powder to the powder booth 21 through the guns 22 and 23, while the powder bed 28 (fed by bin 29) supplies polyolefin powder through guns 24 and 25 to the powder booth 21.

In this process, the interlayer powder is provided through separate spray guns 23 and 24 discharging pure powder of each component. The arrangement of the gun spray patterns in the powder booth 21 provides a changing proportion of interlayer content over the spectrum from essentially pure epoxy resin adjacent to the primer coating, increasing gradually in polyolefin content to pure polyolefin at the top of the interlayer, to provide the best bonding surface for the polyolefin sheath which is applied by the gun 25. A powder discharge duct 30 eliminates dust and excess powder to reclaim the powders and to avoid clogging in the powder booth 21.

In order to achieve the best results according to the invention, a fusion bonded epoxy powder should be used. There are numerous powder coating systems based on epoxy or epoxy-novolac resins which are commercially available and which can be used in the coating system of the present invention. Examples include 3M Scotchkote 206N Standard, 206N slow, Napko 7-2500 and Valspar D1003LD.

The polyolefin powder preferably utilized in the present invention is a polyethylene within the specific gravity range 0.915 to 0.965, preferably between 0.941 to 0.960, or polypropylene. The melt flow index ranges for the product should be within 0.3 to 80 grams per 10 minutes, and preferably within 1.5 to 15 grams per 10 minutes for best results.

The polyolefin powder may be blended with additives such as UV stabilizers, antioxidants, pigments and fillers prior to grinding into powder, and the particle size of the powder should be less than 250 microns, preferably not more than 100 microns.

The coatings obtained by the methods described herein using various combinations of epoxy and polyolefin powders falling within the above specifications, exhibited better moisture permeation and impact resistance than fusion bond epoxy coatings per se. In fact, the physical and performance properties of the coatings manufactured according to the invention were demonstrated to be as good as or better than most three layer pipe coating systems, and better than all two layer systems, as demonstrated by the outline of typical properties below:

| Property | Test Method | Result |
|---|---|---|
| Hot Water Immersion | (28 days at 100° C.) | no significant loss of adhesion no undercutting or layer separation |
| Cathodic Disbondment | ASTM G-8 modified (28 days at 65° C., 3% NaCl, −1.5 V) | <8 mm |
| Impact Resistance | ASTM G-14 (16 mm tapp, −30° C.) | >5 Joules |
| Bendabilty | ASTM G-11 (−30° C.) | Angle of deflection 5 degrees per pipe diameter length in inches |

We claim:

1. A method of applying a protective coating to a metal pipe, comprising the steps of:

(a) preheating the pipe to a temperature between about 175° C. and 275° C.;

(b) conveying the pipe in the direction of its length through a powder booth while rotating the pipe about its axis;

(c) sequentially applying successive powder coverings to the outer surface of the preheated pipe as as said pipe makes a single pass through the powder booth without reheating, said successive powder coverings comprising, respectively, (i) a first powder covering comprising epoxy resin, the epoxy fusing to form a primer coating having a thickness between about 100μ and 400μ bonded to the pipe surface;

(ii) a second power covering comprising a mixture of epoxy resin and polyolefin, the proportion of epoxy resin being between about 20% and about 80% by weight, said second covering forming over the primer coating an interlayer of interspersed domains of epoxy and polyolefin of thickness between about 100μ and about 400μ;

(iii) a third powder covering comprising polyolefin covering the interlayer to a thickness between about 200μ and about 1000μ, said third powder covering melt-fusing to form a smooth continuous sheath bonded to the interlayer; and (d) cooling the coated pipe to ambient temperature.

2. A method of applying a protective coating to a metal pipe, as claimed in claim 1, wherein the melt-fusing of said third power covering is effected by external application of heat at a position external to the powder booth.

3. A method of applying a protective coating to a metal pipe, as claimed in claim 1, wherein said powder coverings are applied electrostatically to the outer surface of the pipe.

4. A method of applying a protective coating to a metal pipe, as claimed in claim 1, further comprising the step of blast cleaning the surface of the pipe prior to preheating the pipe.

5. A method of applying a protective coating to a metal pipe, as claimed in claim 1, wherein the polyolefin of said second powder covering comprises a mixture of unmodified polyolefin and modified polyolefin, the proportion of modified polyolefin being in the range 20% to 50% by weight.

6. A method of applying a protective coating to a metal pipe,.as claimed in claim 5, wherein said second powder covering is applied as a premixture of epoxy resin and polyolefin.

7. A method of applying a protective coating to a metal pipe, as claimed in claim 5, wherein said second powder covering is applied by spraying the epoxy resin and polyolefin constituents of said mixture simultaneously from separate spray guns.

8. A method of applying a protective coating to a metal pipe, as claimed in claim 7, wherein said separate spray guns are arranged to apply the epoxy resin and polyolefin constituents of said mixture to said primer coating to form an interlayer graded in composition from substantially all epoxy resin adjacent said primer coating to substantially all polyolefin adjacent said third powder covering.

9. A method of applying a protective coating to a metal pipe, as claimed in claim 5, wherein the powdered polyolefin consists of particles of polyolefin less than about 250μ in size.

10. A method of applying a protective coating to a metal pipe, as claimed in claim 5, wherein the powdered polyolefin exhibits a melt flow index from about 0.3 to 80 grams/10 minutes.

11. A method of applying a protective coating to a metal pipe, as claimed in claim 10, wherein the melt flow index range of the powdered polyolefin is between about 1.5 and 15 grams/10 minutes.

12. A method of applying a protective coating to a metal pipe, as claimed in claim 5, wherein the pipe is preheated to a temperature to about 232° C. and about 260° C.

13. A method of applying a protective coating to a metal pipe, as claimed in claim 1, wherein the polyolefin of said second powder covering is unmodified polyolefin.

* * * * *